US008707641B2

(12) United States Patent
Rummelhoff

(10) Patent No.: US 8,707,641 B2
(45) Date of Patent: Apr. 29, 2014

(54) TELESCOPIC CANNING SLEEVE FOR FORMING VOIDS IN CONCRETE SLABS

(75) Inventor: Robert Rummelhoff, Vancouver (CA)

(73) Assignee: Kanex Patents Ltd., Vancouver, British Columbia (CA)

( * ) Notice: Subject to any disclaimer, the term of this patent is extended or adjusted under 35 U.S.C. 154(b) by 0 days.

(21) Appl. No.: 13/614,847

(22) Filed: Sep. 13, 2012

(65) Prior Publication Data

US 2013/0020460 A1 Jan. 24, 2013

Related U.S. Application Data

(63) Continuation of application No. 12/161,953, filed as application No. PCT/CA2007/000014 on Jan. 4, 2007, now abandoned.

(60) Provisional application No. 60/760,958, filed on Jan. 23, 2006.

(51) Int. Cl.
*E04C 2/52* (2006.01)

(52) U.S. Cl.
USPC ..... 52/220.8; 249/184

(58) Field of Classification Search
USPC ..... 52/220.8, 577; 220/8; 249/178, 184
See application file for complete search history.

(56) References Cited

U.S. PATENT DOCUMENTS

| | | | | |
|---|---|---|---|---|
| 879,370 | A * | 2/1908 | Dennison | 220/8 |
| 2,695,735 | A * | 11/1954 | Doornik | 222/386 |
| 3,937,995 | A * | 2/1976 | DeVito | 313/49 |
| 4,596,340 | A * | 6/1986 | Luther | 220/8 |

OTHER PUBLICATIONS

Thunderbird Canning Sleeves (2006 archived webpage).*

* cited by examiner

*Primary Examiner* — Jeanette E Chapman
*Assistant Examiner* — Daniel Kenny
(74) *Attorney, Agent, or Firm* — Gowling Lafleur Henderson LLP

(57) ABSTRACT

A two-piece cylindrical telescopic canning sleeve comprising an inner lower member and an upper outer member. The outer member is provided with at least one set of a plurality of engagement devices. The inner lower member is provided with at least one set of a plurality of engagement devices complimentary to the engagement devices provided with the outer member. The telescopic canning sleeve is assembled for use by aligning the engagement devices of the outer member with the engagement devices of the lower member, then sliding the outer member over the inner member until the desired functional height of the canning sleeve is reached after which, the outer member is frictionally engaged with the inner member by twisting the outer sleeve member to the inner member so that the complimentary engagement devices frictionally communicate.

6 Claims, 4 Drawing Sheets

TELESCOPIC CANNING SLEEVE FOR FORMING VOIDS IN CONCRETE SLABS

TECHNICAL FIELD

This invention relates to the construction of concrete floors and slabs provided with voids extending therethrough. More particularly, this invention relates to pipe sleeves and canning sleeves used for forming voids in poured concrete floors and slabs.

BACKGROUND ART

Multiple-story, multiple-unit office and housing structures are constructed with concrete floors and slabs for structural stability and load-bearing capacity. Such concrete floors and slabs are typically provided with numerous various-sized superposed voids, cavities, holes and openings formed through multiple vertically aligned floors to enable the installation and supply of plumbing, electrical wiring, electronic cables, heating and cooling ductworks and other required and desired services and amenities to each floor. Concrete floors poured for multiple-story structures require precise positioning and superposed alignment of such voids, cavities, holes and openings to enable convenient and efficient positioning of water supply and waste removal pipelines, and wiring conduits from the bases of the structures to their top floors, and are formed by the precise positioning, aligning and securing of hole-forming devices to construction baseplates onto which concrete is poured, finished and set to form the floors and slabs. Hole-forming devices for these purposes are well-known and are commonly referred to as pipe sleeves or canning sleeves or cores.

Present day skyscraper and super-skyscraper building structures are provided with service rooms to house electrical, plumbing and heating/cooling substations on located on multiple floors interdispersed along the vertical height of the building structures. Concrete floors on which such service rooms are installed, must be provided with thicker depths in order to support the added weights of service equipment. The thicknesses of concrete floors bearing substation service rooms must confirm to local building codes and can vary between 12" to 20" depending on local regulatory requirements as compared to thickness of non-service concrete floor requirements of 8" to 12". Numerous types of stackable telescoping pipe and canning sleeves have been developed to provide hole-forming devices that can be used to form voids, cavities, holes or openings in concrete floors of different thickness thereby making it possible for a single type of a device to be used on a job site. The prior art telescoping pipe and canning sleeves are commonly manufactured with plastics material for economy and ease of portability and use. However, such plastic telescoping pipe or canning sleeves are commonly collapsed or deformed or displaced by biasing, compressive and torsioning forces caused by the dispensing, distribution and setting of wet concrete onto baseplates whereon the telescoping sleeves were installed. The resulting misaligned and mis-positioned voids must be repaired, i.e., repositioned by boring or drilling or jack-hammering into the set concrete floors. Consequently, the preferred hole-forming devices currently favoured in building construction are single-length units manufactured by sectioning PVC pipe into selected lengths. Although such PVC hole-forming devices are durable, multiple lengths are required in order to provide voids, cavities, holes and openings through floors of different thicknesses.

DISCLOSURE OF THE INVENTION

The exemplary embodiments of the present invention, at least in preferred forms, are directed to two-piece cylindrical telescopic canning sleeves for forming voids, cavities, holes and openings that continuously extend through poured concrete floors and slabs.

According to one preferred embodiment of the invention, there is provided a two-piece cylindrical telescopic canning sleeve comprising a lower inner member and an upper outer sleeve. The outer sleeve is provided with at least one set of a plurality of vertically-aligned spaced-apart inward-facing engaging devices. The inner lower member is provided with at least one set of a plurality of engagement devices that are complimentary to the engagement devices provided with the outer sleeve. The telescopic canning sleeve is assembled for use by aligning the engagement devices of the outer sleeve with the engagement devices of the inner member, and then slidingly engaging the outer sleeve over the inner member until the desired functional height of the canning sleeve is reached after which, the outer sleeve and/or the inner member is rotationally manipulated to frictionally engage the complimentary engagement devices. It is preferable that the telescopic canning sleeve of the present invention comprises a sturdy and durable plastics material.

According to a preferred aspect of the invention, the outer sleeve is provided with at least one set of a plurality of vertically-aligned spaced-apart inward-facing dimples. The inner lower member is provided with at least one set of a plurality of equidistantly spaced-apart horizontal channels communicating with a vertical channel. Spacing of the dimples is complimentary to the spacing of the horizontal channel. The telescopic canning sleeve is assembled for use by aligning the dimples of the outer sleeve with the vertical channel of the inner member, and then sliding the outer sleeve over the inner member until the desired functional height of the canning sleeve is reached after which, the outer sleeve is rotationally engaged with the inner member by twisting the outer sleeve so that the dimples provided therein slidingly communicate with the horizontal channels provided therein the inner member. It is preferred that at least one of the outer sleeve and inner member configured to provide frictional engagement when the outer sleeve and inner member are rotationally engaged.

According to another preferred aspect, the inner member is provided with a flange at its base. The telescopic canning sleeve is secured to a concrete-forming baseplate by nailing or screwing through the flange.

According to yet another preferred aspect, the lower inner member of the telescopic canning sleeve of the present invention is usable separately to provide voids, cavities, holes and openings that continuously extend through poured concrete floors and slabs.

According to a further preferred aspect, the outer sleeve is provided with a flange at its base, said flange securable to a concrete-forming baseplate by nailing or screwing. Such outer sleeves provided with flanged bases can be used exclusive of the inner sleeves to provide voids in concrete floors to the depth of the height of the flanged outer sleeve.

According to another preferred aspect, the upper outer sleeve of the telescopic canning sleeve of the present invention is used separately to provide voids, cavities, holes and openings that extend into and through poured concrete floors and slabs.

According to another preferred embodiment of the invention, there is provided a mould configured to form the two-piece telescopic canning sleeve of the present invention as a single unit whereby the flange provided at the base of the inner member is frangibly interconnected with the flange provided at the base of the outer sleeve.

According to a preferred aspect, the telescopic canning sleeve of the present invention the single unit comprising the two-piece telescopic canning sleeve of the present invention is moulded by an injection-moulding process.

According to another preferred aspect, the telescopic canning sleeve of the present invention the single unit comprising the two-piece telescopic canning sleeve of the present invention is moulded by a blow-moulding process.

BRIEF DESCRIPTION OF THE DRAWINGS

The present invention will be described in conjunction with reference to the following drawings, in which.

BEST MODES FOR CARRYING OUT THE INVENTION

Figure 1:
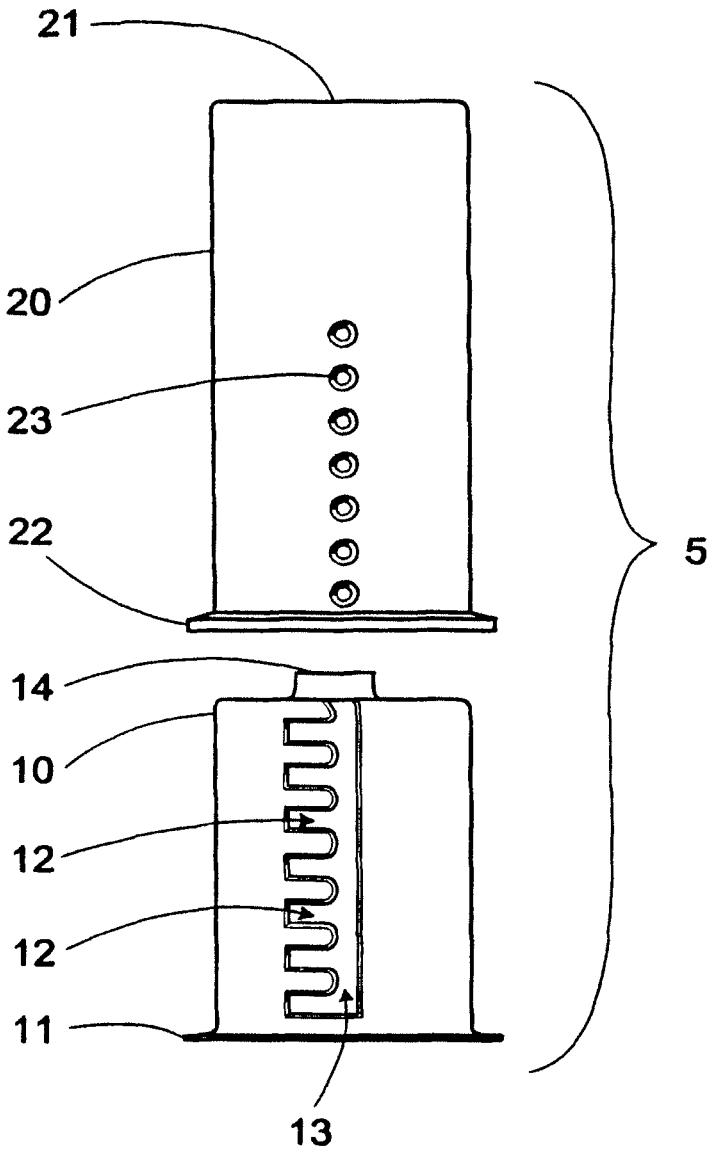
FIG. 1 is a side view of one embodiment of the present invention showing the inner member separated from the outer sleeve.
Figure 2:
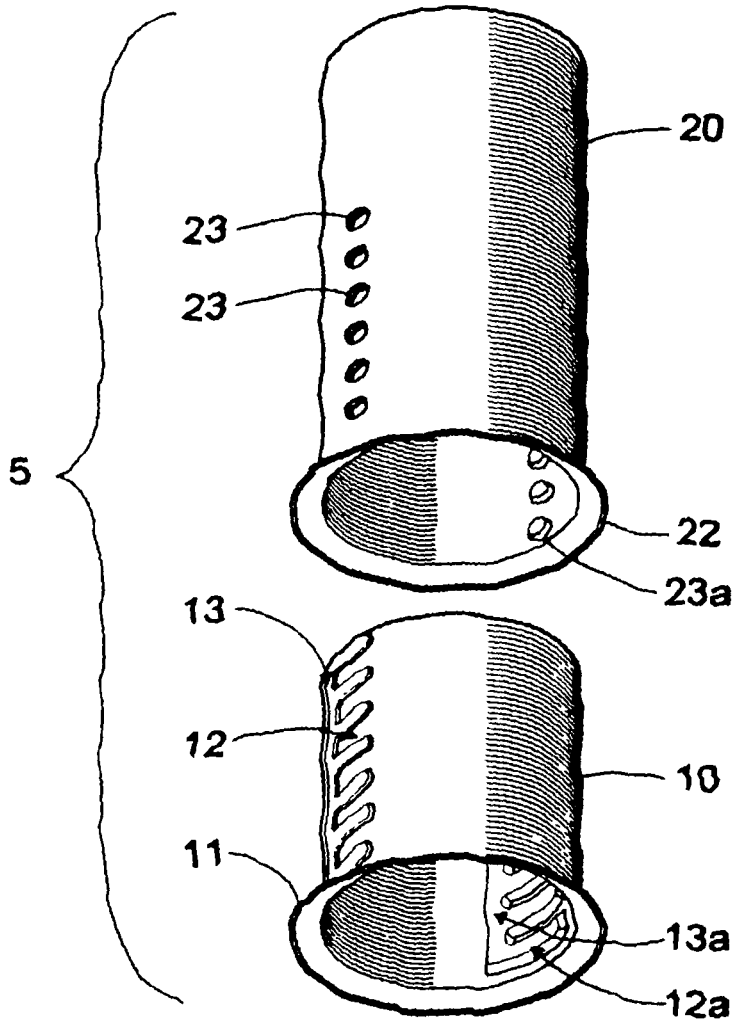
FIG. 2 is a perspective view of the embodiment shown in FIG. 1.

An exemplary embodiment of the telescopic canning sleeve of the present invention is shown in the accompanying drawings, and is generally referred to by the numeral 5. As can best be seen in FIGS. 1 and 2, the telescopic canning sleeve 5 comprises a cylindrical lower inner member 10 which is configured to slidingly communicate within a cylindrical upper outer sleeve 20. The inner member 10 is provided with a flange 11 at its base and an opposing top 14 provided with a port hole. A plurality of recessed equidistantly spaced-apart horizontal channels 12 communicating with a single recessed vertical channel 13 are provided on the side of the inner member 10 as shown in FIG. 1. The outer sleeve 20 is provided with a flange 22 at its base and a solid top 21 at the end opposing its flanged base. A plurality of inward-facing spaced-apart vertically-aligned dimples 23 are provided on the side of the outer sleeve 20, wherein the spacing of said dimples 23 corresponds with the spaced-apart horizontal channels 12 on the lower member 10.

Figure 3:
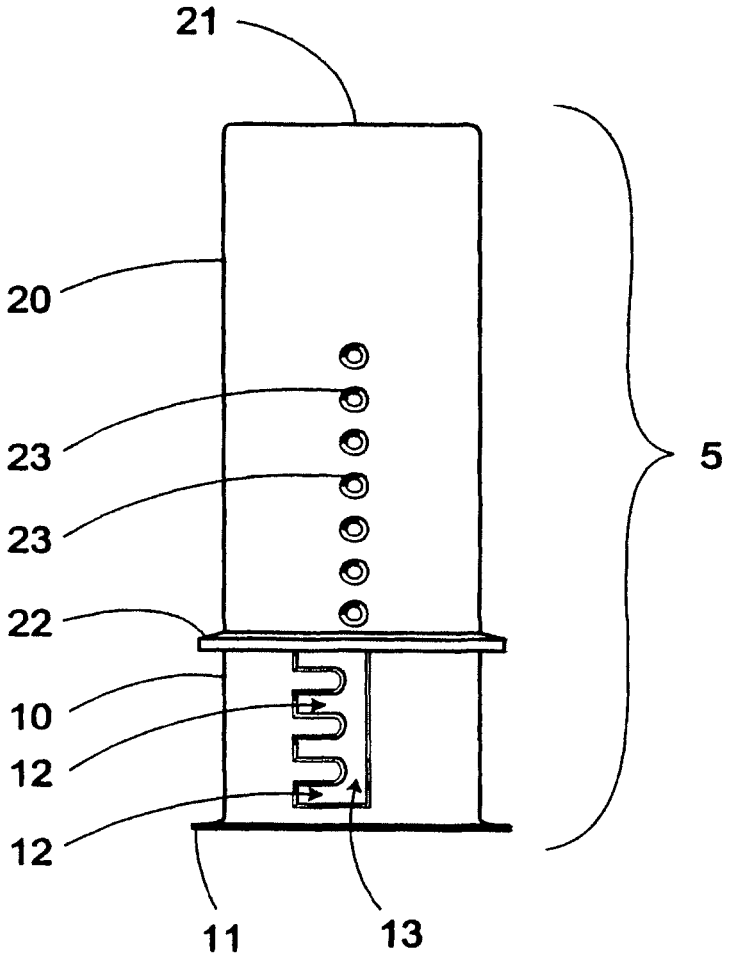
FIG. 3 is a side view of embodiment from FIG. 1, showing the inner member cooperatingly engaged with the outer sleeve.

The telescopic canning sleeve 5 of the present invention is adjustable to enable the forming of voids in poured concrete floors with different thicknesses by sliding the upper sleeve 20 over the inner member 10 with the dimples 23 aligned to slidingly communicate with channel 13. When the height of the telescopic canning sleeve 5 reaches the requisite height needed to form a void that passes completely through the specified thickness of concrete floor to be poured, then the upper sleeve 20 is twisted sideways so that the dimples 23 slidingly communicate with and engage horizontal channels 12 as shown in FIGS. 3. To ensure stability of the telescopic canning sleeve 5 and resistance to the biasing, compressive and torsioning forces caused by the dispensing, distribution and setting of wet concrete, it is preferable that at least three dimples 23 of the upper sleeve 20 are slidingly engaged with three horizontal channels 12 in the lower member 10. For maximum stability of the telescopic canning sleeve 5 during pouring and setting of concrete, the inner member and outer sleeve may be configured to enable frictional engagement of the dimples 23 with the horizontal channels 12, for example, by providing horizontal channels with a shallower depth than the height of the dimples. Alternatively, at least one longitudinal ridge (not shown) may be provided on the inner surface of the outer sleeve with at least one complementary longitudinal ridge provided on the outer surface of the inner member so that one ridge frictionally engages and interlocks with the other ridge as dimples provided on the outer sleeve and the horizontal channels provided on the inner member are slidingly engaged.

The telescopic canning sleeve 5 is secured to a baseplate by nailing or screwing or stapling through flange 11 into the underlying baseplate (not shown). The accompanying drawings 1-3 illustrate a telescopic canning sleeve of the present invention that measures 50.8 cm (20 in) in height from the flange 11 of the lower member 10 to the top surface 21 of the upper sleeve 20. Accordingly the height of the upper sleeve 20 in this exemplary embodiment is 30.5 cm (12 in) while the height of the lower member 10 is 20.3 cm (8 in). The dimples 23 and horizontal channels 12 are spaced apart by 2.5 cm (1 in). Consequently, the telescopic canning sleeve described in this exemplary embodiment can be used for forming voids which pass completely through concrete floors poured with thicknesses of 33.0, 35.5, 38.0, 40.6, 43.2, 45.7, 48.3, and 50.8 cm (i.e., 13, 14, 15, 16, 17, 18, 19 and 20 in). An advantage of the present invention is that the inner lower member 10 and the upper sleeve 20 can be used separately and individually to form voids therethrough 20.3-cm thick (i.e., 8 in) concrete floors and 30.5-cm (i.e., 8 in) concrete floors. After the concrete floors have set, then the top regions 21 and 14 are simply knocked out to provide continuous voids, cavities, holes and openings therethrough the concrete floors.

Figure 4:
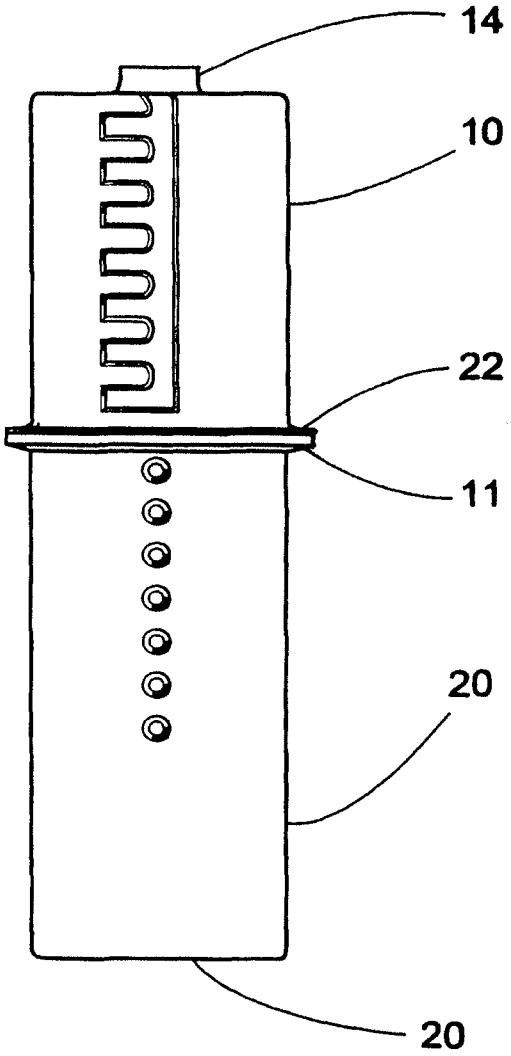
FIG. 4 is a side view of another embodiment of the present invention.

It is preferred that the telescopic canning sleeve 5 of the present invention comprises a plastics material that is sufficiently sturdy to withstand the biasing, compressive and torsioning forces caused by the dispensing, distribution and setting of wet concrete. Examples of such plastics material include but are not limited to polyvinylchloride (PVC) plastics and high-density polyethylene (HDPE) plastics. The plastics materials may be injection moulded or blow moulded into a mould configured to provide a one-piece unit comprising the telescopic canning sleeve 5 wherein the flange 11 of the inner lower member 10 is frangibly interconnected with flange 22 of the upper outer sleeve 20 as shown in FIG. 4. The moulding process provides a port 14 through the plastics materials were injected into the mould. Manufacturing the telescopic canning sleeve 5 as a one-piece unit makes it very easy to handle, package and ship the canning sleeve as an integral unit to a job site. When needed for use, the one-piece unit is simply snapped apart at the juncture of flanges 11 and 22, after which the upper outer sleeve is slipped over the lower inner member and then adjusted to the requisite height as described above. It is to be noted that the port 14 at the top of lower member 10 enables air to egress from the chamber formed when the upper outer sleeve 20 is slipped over the inner lower member 10.

It is preferred that the mould is configured to provide: (a) two opposing sets of interconnected horizontal and vertical channels in the inner lower member, designated as set 12 and 13 opposing set 12*a* and 13*a* in FIG. 2, and (b) two sets of opposing vertically aligned dimples in the upper outer sleeve 20, said opposing dimples designated as 23 and 23*a* in FIG. 2. However, those skilled in these arts will understand that the telescopic canning sleeve 5 of the present invention can be provided with one set of complimentary dimples in the upper outer sleeve that are cooperatable with one set of horizontal channels interconnected with one vertical channel in the lower inner member. Alternatively, the telescopic canning sleeve may be provided with three or more sets of complementary dimples, and interconnected horizontal and vertical channels.

While this invention has been described with respect to the preferred embodiments, it is to be understood that various alterations and modifications can be made to the various dimensions, configurations and materials of the telescopic canning sleeve within the scope of this invention.

The invention claimed is:

1. A two-piece cylindrical telescopic canning sleeve for forming voids extending through concrete floors when said concrete floors are poured, the telescopic canning sleeve comprising:

a cylindrical inner member having an open end provided with an outward-facing flange, said inner member provided with a set of a plurality of equidistantly spaced-apart horizontal channels communicating with a vertical channel; and a cylindrical outer member having an open end provided with an outward-facing flange, said outer member provided with a set of vertically-aligned spaced-apart inward-projecting dimples complementary to the spacing of the horizontal channels provided in the inner member, whereby said inner member and said outer member are configured to slidingly communicate along a longitudinal axis and to frictionally engage when rotated in opposite directions around the longitudinal axis.

2. A two-piece cylindrical telescopic canning sleeve for forming voids extending through concrete floors when said concrete floors are poured, the telescopic canning device comprising:

a cylindrical inner member;

a cylindrical outer member having an open end; said inner member being slidable longitudinally within the outer member; and one set of engagement devices provided on said inner and outer members;

said engagement devices including at least one dimple on one of said inner and outer members and one longitudinal slot and at least one generally transverse slot in the other of the members for receiving the dimple, said slots interconnecting, and said dimple and slots being sized, positioned and dimensioned such that, in a first relative rotational alignment of said inner and outer members, said inner and outer members may be freely telescoped to increase or decrease an overall length of said canning sleeve with said at least one dimple sliding freely in said one longitudinal slot, and in a second relative rotational alignment, said at least one dimple is held frictionally within said at least one transverse slot, thereby preventing telescoping of said inner and outer members, consequently fixing the length of said canning sleeve.

3. The telescopic canning sleeve of claim 2, having at least three projections in alignment in an axial direction of said device, a single longitudinal slot positioned to receive said projections in said first rotational alignment and the same number of transverse slots as the number of projections branching from said longitudinal slot.

4. The telescopic canning sleeve of claim 2, wherein said projections project inwardly from an inner surface of said outer member, and said slots are formed in an outer surface of said inner member.

5. The telescopic canning sleeve of claim 2, wherein said slots are re-entrant grooves formed in a surface of said other of said inner and outer members.

6. The telescopic canning sleeve of claim 2, wherein each of said inner and outer members has an outwardly-facing flange at one end thereof.

* * * * *